US007237974B2

(12) United States Patent
Pfenniger et al.

(10) Patent No.: US 7,237,974 B2
(45) Date of Patent: Jul. 3, 2007

(54) TOOTHBRUSH WITH TOOTHBRUSH BODY AND TOOTHPASTE CONTAINER

(75) Inventors: Adrian Pfenniger, Triengen (CH); Martin Zwimpfer, Lucerne (CH); Franz Fischer, Triengen (CH)

(73) Assignee: Trisa Holding AG, Triengen (CH)

( * ) Notice: Subject to any disclaimer, the term of this patent is extended or adjusted under 35 U.S.C. 154(b) by 0 days.

(21) Appl. No.: 10/705,931

(22) Filed: Nov. 13, 2003

(65) Prior Publication Data

US 2005/0036821 A1 Feb. 17, 2005

(30) Foreign Application Priority Data

Aug. 12, 2003 (DE) ..... 103 37 062

(51) Int. Cl.
*A46B 11/00* (2006.01)

(52) U.S. Cl. ..... 401/123; 401/184; 401/268; 401/118

(58) Field of Classification Search ..... 401/118–130, 401/132–135, 183–185, 144, 156, 162, 268
See application file for complete search history.

(56) References Cited

U.S. PATENT DOCUMENTS

| | | | | |
|---|---|---|---|---|
| 793,259 | A * | 6/1905 | Wilson | 401/124 |
| 1,432,715 | A | 10/1922 | Mendoza | |
| 1,473,766 | A | 11/1923 | Healy | |
| 1,701,030 | A | 2/1929 | Collins | |
| 2,233,522 | A | 3/1941 | Fickle | |
| 2,399,660 | A * | 5/1946 | Boulicault | 132/311 |
| 2,450,002 | A * | 9/1948 | Jackson | 401/124 |
| 2,468,732 | A | 5/1949 | Boulicault | |
| 2,845,645 | A * | 8/1958 | Wishnefsky et al. | 401/124 |
| 2,978,722 | A | 4/1961 | Kusakabe | |
| 3,381,818 | A * | 5/1968 | Cope et al. | 206/524.2 |
| 3,593,725 | A * | 7/1971 | Ortega et al. | 132/311 |
| 3,734,118 | A | 5/1973 | Howard | |
| 3,741,667 | A | 6/1973 | Cesari | |
| 3,763,869 | A | 10/1973 | Sanders | |
| 3,816,007 | A | 6/1974 | Fox | |
| 3,842,851 | A | 10/1974 | Pipitone | |
| 4,068,974 | A | 1/1978 | Meyer et al. | |

(Continued)

FOREIGN PATENT DOCUMENTS

CH 602 193 A 7/1978

(Continued)

*Primary Examiner*—Khoa D. Huynh
(74) *Attorney, Agent, or Firm*—Oliff & Berridge, PLC

(57) ABSTRACT

A toothbrush has a toothbrush body, and a handle part wherein a toothpaste container can be removably inserted therein. The toothpaste container has a handle shell part which, with the toothpaste container inserted into the handle part, forms part of the outer surface of a handle. The toothpaste container essentially maintains its form during teeth cleaning and transmits loading which occurs, irrespective of the filling level of the toothpaste container of the toothbrush. The mounting of the toothpaste container on the toothbrush body allows very straightforward and quick removal and opening or insertion and closure of the toothpaste container. The container holder is provided with a closure pin, wherein when the toothpaste container is inserted into the handle part, a sealed closure of the toothpaste container is ensured. With the toothpaste container removed from the handle part, it is possible for toothpaste to be squeezed out of the toothpaste container.

21 Claims, 5 Drawing Sheets

U.S. PATENT DOCUMENTS

| | | | | |
|---|---|---|---|---|
| 4,152,804 | A | 5/1979 | Morris | |
| 4,199,270 | A | 4/1980 | Tomasini | |
| 4,275,750 | A | 6/1981 | Clark | |
| 4,384,645 | A * | 5/1983 | Manfredi | 401/123 |
| 4,527,574 | A * | 7/1985 | Manfredi | 401/124 |
| 4,530,369 | A | 7/1985 | Adams | |
| 4,693,622 | A | 9/1987 | Booth | |
| 4,866,809 | A | 9/1989 | Pelletier | |
| 4,919,155 | A | 4/1990 | Yasuda | |
| 5,028,158 | A | 7/1991 | Fey | |
| 5,382,106 | A * | 1/1995 | Voigt | 401/155 |
| 5,735,011 | A * | 4/1998 | Asher | 15/167.1 |
| 5,761,759 | A * | 6/1998 | Leversby et al. | 15/167.1 |
| 5,911,532 | A * | 6/1999 | Evancic | 401/191 |
| 6,227,209 | B1 | 5/2001 | Kim et al. | |
| 6,238,118 | B1 | 5/2001 | Tryon | |
| 6,315,556 | B1 | 11/2001 | Stewart | |
| 6,325,076 | B1 | 12/2001 | Ramirez | |
| 6,672,783 | B1 * | 1/2004 | Licata et al. | 401/123 |
| 2003/0077107 | A1 | 4/2003 | Kuo | |

FOREIGN PATENT DOCUMENTS

| | | | |
|---|---|---|---|
| DE | 296 13 012 | U1 | 12/1996 |
| DE | 197 53 362 | A | 6/1999 |
| DE | 198 05 962 | A1 | 8/1999 |
| EP | 0 594 529 | A1 | 4/1994 |
| FR | 2 658 400 | A | 8/1991 |
| FR | 2658400 | | 8/1991 |
| FR | 2 770 112 | A1 | 4/1999 |
| GB | 418 956 | A | 11/1934 |
| GB | 469 793 | A | 8/1937 |
| GB | 2 343 619 | A | 5/2000 |
| GB | 2 359 738 | A | 9/2001 |
| GB | 2 375 040 | A | 11/2002 |
| WO | WO 99/63857 | | 12/1999 |

* cited by examiner

TOOTHBRUSH WITH TOOTHBRUSH BODY AND TOOTHPASTE CONTAINER

This application claims priority to German Patent Application No.: 103 37 062.5, filed on Aug. 12, 2003.

BACKGROUND OF THE INVENTION

1. Field of Invention

The invention relates to a toothbrush, to a toothbrush body and to a toothpaste container.

The toothbrush according to the invention is a toothbrush with a toothbrush body into which a toothpaste container can be inserted.

2. Description of Related Art

Toothbrushes and toothpastes are used for oral hygiene and for massaging the gums. In this way, teeth cleaning helps to keep the teeth, mouth and throat healthy. In accordance with the recommended daily usage, toothbrush users generally require a toothbrush with straightforward handling, an ergonomic design and a long service life along with the best possible cleaning action.

In respect of joint space-saving storage and transportation, for example as a travel toothbrush, but also in particular as far as straightforward handling and ergonomics are concerned, technical solutions in which a toothbrush body is connected to a toothpaste container (or vice versa) to form a toothbrush are particularly advantageous. A distinction can be made between essentially two groups of technical solutions.

The first group comprises toothbrushes in which toothpaste is conveyed through a channel which leads from a toothpaste container, through a neck of the toothbrush, to the bristle covering on the head of the toothbrush. Such articles are described, for example, in U.S. Pat. No. 4,199,270 and U.S. Pat. No. 4,068,974. This group of toothbrushes proves to be very user-friendly, but entails problems in respect to the toothpaste storage. For example, an open channel end on the head of the toothbrush may result in the toothpaste drying out or running out. In U.S. Pat. No. 4,068,974, this problem is solved by the use of valves. The production of this embodiment, however, is complex and involves relatively high costs.

In the case of the second group of toothbrushes, the toothpaste container, for the purpose of applying the toothpaste to the bristle covering of the head, is separated from a toothbrush body of the toothbrush. Such articles are described, for example, in U.S. Pat. No. 6,325,076 and U.S. Pat. No. 6,227,209. Once the toothpaste has been applied, the toothpaste container is reconnected to the toothbrush body. In contrast to the first group, there is no need for any channel in the neck of the toothbrush for guiding the toothpaste to the head.

FR-A-2658400 discloses a toothbrush in which a toothpaste tube forms an end region of the handle of the toothbrush. The toothpaste tube is fixed to a handle part, at the free end thereof, by virtue of its dispensing head being screwed into a threaded hole. Once the exposed toothpaste tube has been unscrewed, toothpaste can be applied to the bristles of a head of the toothbrush by virtue of pressure being applied to the toothpaste tube.

In contrast to a toothbrush with an exposed toothpaste tube, U.S. Pat. No. 6,227,209 describes a toothbrush in which the toothpaste container is located in a fixed, cylinder-like sleeve which is provided with a cut-out and with covers at its two ends. The stable sleeve absorbs the loading during teeth cleaning and transmits it to the head of the toothbrush via a handle part, which is fixed to it, and a neck. The cut-out comprises part of the sleeve and a slot-like part in the cover directed toward the handle part. The cut-out serves, on the one hand, for inserting the toothpaste container into the sleeve and, on the other hand, for applying pressure to the flexibly elastic toothpaste container, and thus squeezing out the toothpaste, using a finger, which can engage through the cut-out in the sleeve. A releasable connection between the handle part and the toothpaste container enclosed by the sleeve is ensured by virtue of a thread on the dispensing head of the toothpaste container, said thread engaging through the cut-out part in the cover, interacting with a threaded hole in the free end of the handle part of the toothbrush. However, the screw connection proves to be impractical in terms of handling for everyday use.

The object is thus to provide a toothbrush with a toothpaste container which is easy to insert and remove, has a straightforward construction with a minimal number of individual parts and is cost-effective to produce.

SUMMARY OF THE INVENTION

This object is achieved according to the invention by a toothbrush, by a toothbrush body and by a toothpaste container having the features set forth herein.

The basic idea of the toothbrush according to the invention is to provide a toothbrush which has a toothbrush body and a toothpaste container insertable therein and in the case of which a shell-like container holder is formed on a handle part of the toothbrush body, the container holder, with the toothpaste container inserted into the handle part, partially enclosing a container body, and the container body having a stable handle shell part projecting beyond the container holder. The handle shell part, together with the handle part, forms the surface of a handle of the toothbrush. The handle essentially maintains its form when subjected to loading which occurs during teeth cleaning, irrespective of the filling level of the toothpaste container. The mounting of the toothpaste container in the handle part of the toothbrush body, at the same time, allows very straightforward and quick removal and opening of the toothpaste container. The handle part is preferably provided with a closure pin, with the result that, with the toothpaste container inserted into the handle part, a sealed closure of the toothpaste container is ensured. By virtue of slight finger pressure being applied to a weakened, flexibly elastic zone of the toothpaste container, it is possible to squeeze the toothpaste out of the toothpaste container removed from the handle part. This weakened zone is, for example, a recess on the toothpaste container, at which the wall thickness of the toothpaste container is lower than in the rest of the container. With a toothpaste container inserted into the handle part, the weakened zone is covered over by the container holder.

BRIEF DESCRIPTION OF THE DRAWINGS

Particularly advantageous embodiments are shown, purely schematically, in the following figures, in which.

DETAILED DESCRIPTION OF PREFERRED EMBODIMENTS

Figure 1:
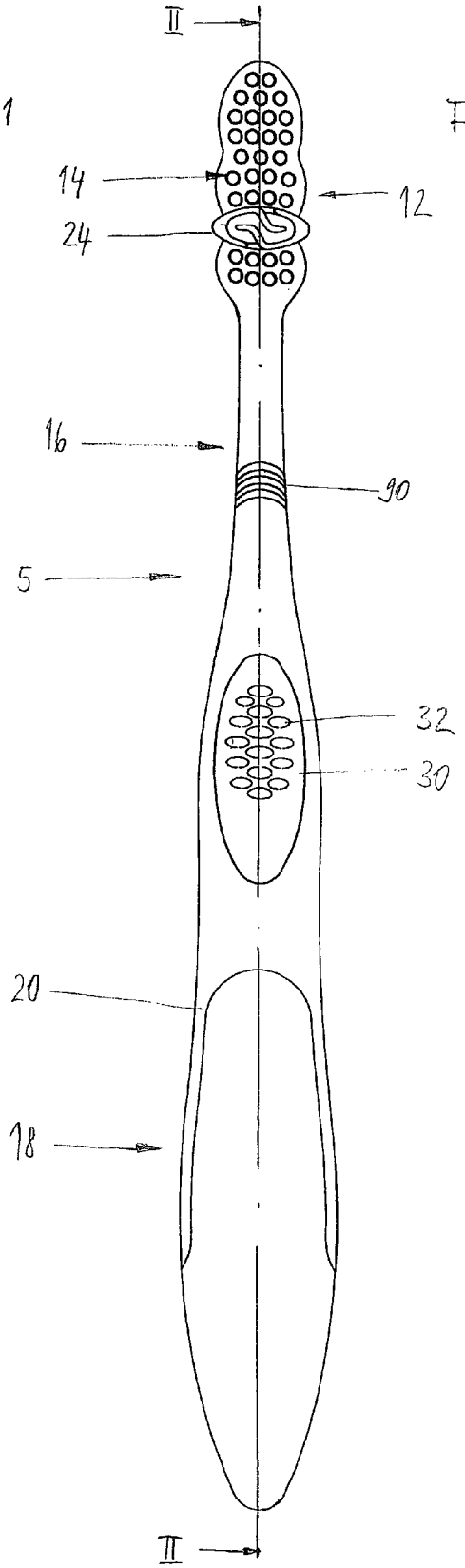
FIG. 1 shows a plan view of a toothbrush with a toothbrush body and a toothpaste container inserted therein.
Figure 2:
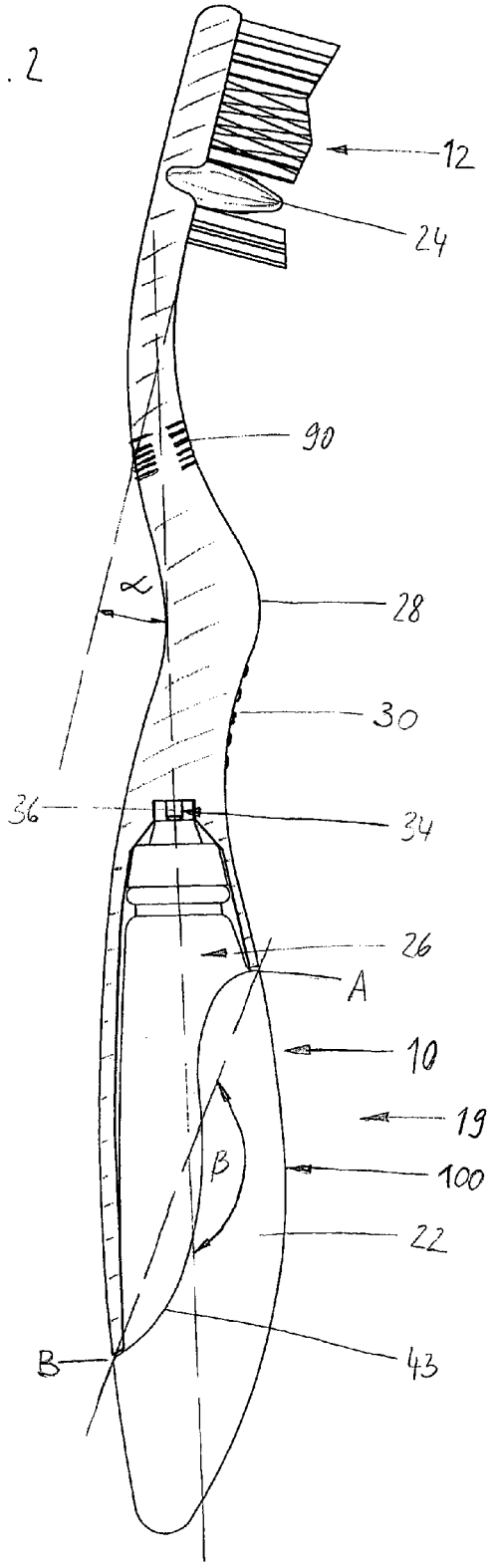
FIG. 2 shows a longitudinal section of the toothbrush body of the toothbrush from FIG. 1 along line II—II with the toothpaste container inserted.

A toothbrush according to the invention with a toothpaste container 10 inserted in a toothbrush body 5 is shown in plan view in FIG. 1 and in longitudinal section in FIG. 2. The toothbrush body 5 comprises a head 12, which is covered with bristles 14, a neck 16 and an adjoining handle part 18. On its region, which is located opposite the head 12, the handle part 18 has a container holder 20, into which the toothpaste container 10, which has a handle shell part 22, is inserted in a releasable manner. The handle part 18 and the toothpaste container 10 together form a handle 19.

An axis in continuation of that side of the head 12 which bears bristles 14 encloses an angle $\alpha$ of less than 60°, preferably less than 30°, with the longitudinal axis of the inserted toothpaste container 10. This slight angling results in the bending forces which occur when the toothpaste container 10 is inserted into the handle part 18, and act on the neck 16 and on the handle part 18 perpendicularly to the longitudinal axis of the toothbrush, being limited and in avoidance of high pressure on the bristles 14 when the toothbrush body 5 is held.

The head 12 is covered with bristles 14 or clusters of bristles and has a flexibly elastic restraining element 24 for partially holding back toothpaste 26 on the head 12. As an alternative, it is also possible for the head 12, or preferably the bristle-covered part of the head 12, to be exchangeable. In this case, it is connected in a releasable manner to the neck 16 or an accommodating part fastened on the head 12.

The arcuate neck 16, which is curved in the direction counter to the free end of the bristles 14, adjoins the head 12. It terminates at the transition to the handle part 18 after an elevation 28 in front of a thumb rest 30, said elevation 28 following in the direction of the free ends of the bristles 14. The neck 16 and the handle part 18 contain a stable, structure-forming rigid component, preferably made of plastic which is chemically resistant to toothpaste 26 and mouthwash, such as polyethylene terephthalate (PET), acrylonitrile-butadiene-styrene copolymers (ABS), thermoplastic copolymers comprising styrene and acrylonitrile (SAN), isoplastic material, polymethyl methacrylate (PMMA) or polypropylene (PP). The modulus of elasticity in tension of the polypropylene which is preferably used is preferably greater than 1200 Mpa. This ensures sufficient stability of the handle part 18 when subjected to loading during teeth cleaning.

Flexibly elastic damping elements 90 are integrated in encircling grooves of the neck 16, and these give rise to greater elasticity of the neck 16 and damp bending forces which occur on the neck 16.

The thumb rest 30 is provided with protuberances 32 and/or indents made of flexibly elastic polymer material. In conjunction with that side of the elevation 28 which slopes down in the direction of the free end of the handle 19, it prevents the thumb from slipping off in the direction of the head 12 during a cleaning movement.

As is shown in FIG. 2, with the toothpaste container 10 inserted into the handle part 18, the container holder 20, which is formed on the handle part 18, encloses part of a container body 42 of the toothpaste container 10 in a shovel-like manner. A closure pin 36 which is formed in the container holder 20 projects in a precisely fitting manner into an outlet opening 34 on a dispensing head 38 of the toothpaste container 10. The closure pin 36 serves for closing the toothpaste container 10 in a sealed manner. The outlet opening 34 has a diameter of less than 6 mm, preferably less than 3 mm. This diameter is selected in order to encourage the user to use toothpaste 26 sparingly and in order to prevent the toothpaste 26 from running out of the toothpaste container 10.

That part of the container holder 20 which is directed toward the head 12 completely encloses the dispensing head 38 of the toothpaste container 10 in the form of a funnel-like clearance. The dispensing head 38 is completely enclosed in this way over at least 5% of the length of the toothpaste container 10. The opening of the funnel-like clearance in the direction of the free end of the handle part 18 preferably has a minimum radius of 10 mm. It is thus possible to clean the clearance, and in particular the surroundings of the closure pin 36, for example using a cotton bud.

In the example shown, the further continuation of the shovel-like enclosure of the toothpaste container 10 is formed asymmetrically in relation to the longitudinal axis of the handle 19. On the bottom side of the toothbrush, which does not bear any bristles 14, the container holder 20 covers over approximately ⅔ of the length of the toothpaste container 10 and thus mechanically assists mounting of the toothpaste container 10. The wall thickness of the handle part 18 is selected to be correspondingly large on this bottom side. As an alternative, it is also possible for the container holder to cover over a smaller part or even, as is shown, for example, in FIG. 8, the entire bottom side of the toothpaste container 10. The third of the length of the handle 19 which remains on the bottom side of the toothbrush in FIG. 2 is formed by the handle shell part 22 itself. On the opposite, top side of the toothbrush, which bears bristles 14, the handle shell part 22 constitutes approximately ⅓ of the surface area of the handle 19. As an alternative, this proportion may likewise be smaller or greater.

The side walls formed by the shovel-like enclosure have a maximum wall thickness of less than 5 mm. The wall thickness decreases preferably continuously as far as the free end of the handle shell part 22, that is to say as far as a transition to the inserted toothpaste container 10.

The handle shell part 22 of the toothpaste container 10, over the entire outer side of the handle 19, adjoins the container holder 20 of the handle part 18 in a preferably precisely fitting and more or less step-free manner along an annular end surface 43, which is illustrated as being S-shaped in the view in FIG. 2. As an alternative, it is also possible for the end surface 43 to be configured such that a side line which is shown in the side view of FIG. 2 is a straight line, stepped line, arcuate line or a combination of the above. An angle β, which is formed by a connecting line from an uppermost point of the side line, which is designated A in FIG. 2, to a lowermost point, designated B, on the bottom side of the toothbrush and the longitudinal axis of the toothpaste container 10 in the direction of the free end of the handle 19 with the toothpaste container 10 inserted, is preferably greater than 90°.

In an area of 10 mm around the transition from the handle part 18 to the handle shell part 22, all the tangential faces of the handle surface are at angles of preferably less than 45° in relation to one another. In addition, there are advantageously no sharp edges.

The more or less step-free continuation of the handle surface prevents water and other liquid or solid substances from penetrating, and thus prevents contamination of the dispensing head and of the toothpaste 26 located in the toothpaste container 10. In addition, the more or less step-free continuation is particularly advantageous for ergonomic reasons and, during teeth cleaning, prevents the occurrence of marks on the inner surface of the hand as a result of pressure being applied.

In the case of loading during teeth cleaning, the handle shell part 22 of the toothpaste container 10 inserted into the toothbrush body 5 maintains its shape virtually unchanged. The forces which are applied, in particular by the ball of the thumb, particularly on that side of the toothbrush which is covered with bristles 14 are transmitted from the handle shell part 22, via the container holder 20, to the handle part 18 and further, via the neck 16, to the head 12 and to the bristles 14. In the case of loading with the toothpaste container 10 inserted, the walls of the container holder 20 prevent the container body 42 from bulging out or bending in and thus help to maintain the form of the toothpaste container 10.

Figure 3:
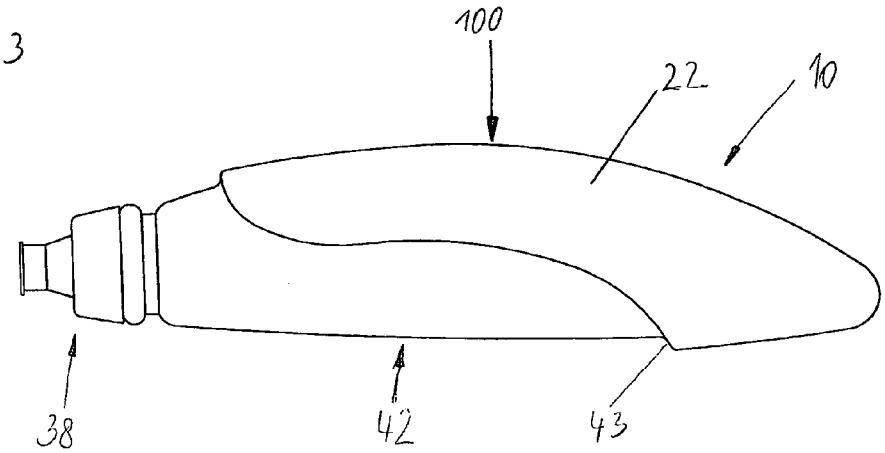
FIG. 3 shows a side view of a toothpaste container.

FIG. 3 illustrates a preferred embodiment of the toothpaste container 10. It has a droplet-like basic shape, over which the handle shell part 22 projects. The resulting, annularly encircling end surface 43 rests in a preferably more or less precisely fitting manner, with the toothpaste container 10 inserted, on a corresponding end surface of the container holder 20. Possible materials for the toothpaste container 10 are polyethylene terephthalate (PET), polycarbonate (PC) and polyvinyl chloride (PVC), preferably polyolefins, in particular polypropylene (PP) or polyethylene (PE).

The toothpaste container 10 is inserted into the handle part 18 of the toothbrush body 5 by virtue of a plug-in movement with the dispensing head 38 in front, in the direction of the head 12 of the toothbrush body 5, oriented more or less along the longitudinal axis of the toothbrush. Depending on the embodiment of the mount for the toothpaste container 10 on the toothbrush body 5, the direction here may be inclined in relation to the longitudinal axis of the toothbrush. Likewise depending on the configuration of the mount, an additional latching-in movement more or less in the direction of the longitudinal axis of the toothbrush, or perpendicularly to this direction, may be necessary for the purpose of arresting the toothpaste container 10 in the handle part 18. As an alternative, in the case of a bayonet or rotary latching-type mounting of the toothpaste container 10 in the handle part 18, the plug-in movement along the longitudinal axis of the toothbrush may be supplemented by a rotary movement through preferably less than 45° about the longitudinal axis. In order to remove the toothpaste container 10, the movements take place in reverse order, counter to the movement direction for insertion.

The toothpaste container 10 can be repeatedly inserted into the handle part 18 and removed therefrom. For the purpose of filling the consumable toothpaste 26 contained, the toothpaste container 10 can be refilled by the user or a replacement container (refill) can be purchased.

The wall thickness of the toothpaste container 10 can vary over the circumference as a whole. In order to make it possible for the toothpaste 26 to be squeezed out once the toothpaste container 10 has been removed, the wall thickness of the container body 42 is preferably less than 2 mm at least some locations. At these locations, the wall has a modulus of elasticity in tension of less than 1400 MPa, if use is made of polyethylene and polypropylene as the container materials. The locations may be, in particular, recesses 52 which are formed laterally on the toothpaste container 10 and are described in more detail herein below in conjunction with FIGS. 6 and 11. The wall thickness of the handle shell part 22 is preferably greater than that of the rest of the container body 42, in order to guarantee the stability of form during use. The dimensional stability may be assisted by ribs 78 which are additionally formed or fitted on the toothpaste container 10. The toothpaste container 10 itself is a hollow body produced, for example, by means of injection molding, injection blow molding, extrusion blow molding, rotational molding, etc.

Depending on the production process selected, but in particular in the case of extrusion blow molding, flash may be produced on a mold parting line of the toothpaste container 10. This flash may be removed or reduced by follow-up machining. Rather than being located on the handle shell part 22, the mold parting line of the container body 42 is preferably always located on that part of the toothpaste container 10 which, in the inserted state, is enclosed by the container holder 20. In this way, it is not possible for the flash or remaining unevenness to disturb the user during teeth cleaning.

The outer dimensions of the toothpaste container 10 are selected such that, in the state in which the latter is inserted into the handle part 18, the handle 19 can easily be held in the hand and guided during cleaning. The largest diameter of the cross section of the toothpaste container 10 in the direction perpendicular to the longitudinal axis is less than 25 mm, and the length is less than 100 mm. The ratio of diameter to length is less than 1:2, preferably 1:4.

The toothpaste container 10 takes up approximately 20% to 60% of the overall length of the toothbrush with the toothpaste container 10 inserted. Its volume is less than 50 ml, preferably between 10 ml and 30 ml, and is between 45% and 95% of the volume of the handle 19. A volume of 30 ml of toothpaste 26 is sufficient for 30 to 60 cleaning operations.

The geometry, the wall thickness and the material of the handle shell part 22 of the toothpaste container 10 are selected such that, the toothpaste container 10 in the open and emptied state, when the handle shell part 22 is subjected to a force of 10 N by means of a centrally positioned pin which is 18 mm in diameter and is oriented more or less perpendicularly to the longitudinal axis of the toothpaste container 10, in the direction of an arrow designated 100 in FIG. 3, the handle shell part 22 will produce a deformation of 1 to 5 mm. In the case of a loading force of 50 N, the deformation of the handle shell part 22 should be approximately 5 mm. Even in the empty state, once the loading force has been removed, the deformations are at least more or less fully eliminated again.

Figure 4:
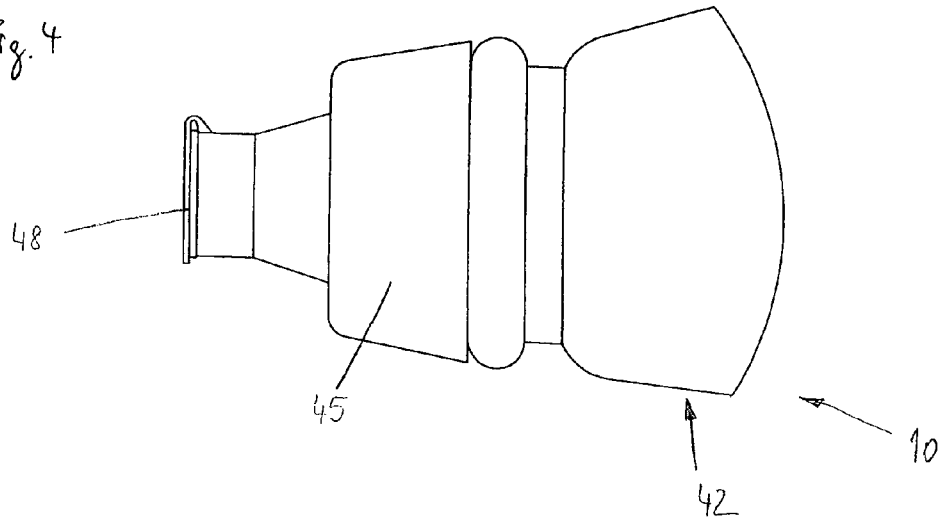
FIG. 4 shows a view of a dispensing head and of part of a container body of a toothpaste container.
Figure 5:
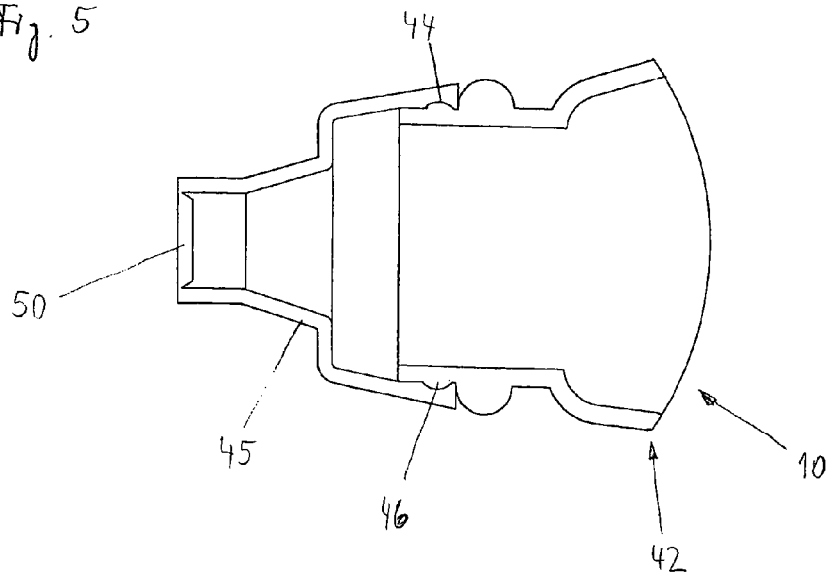
FIG. 5 shows a sectional illustration of a further embodiment of the dispensing head with part of the container body of a toothpaste container.

Two embodiments of the dispensing head 38 of the toothpaste container 10 are illustrated in FIGS. 4 and 5 on a scale which is larger than that of FIG. 3. In this case, a latching groove 44 running around the interior of a cap 45, which preferably consists of a stiffer plastic material than that of the toothpaste container 10, has been latched on an encircling latching bead 46 of a part of the container body 42 which tapers in the form of a neck. As an alternative, it is also possible for the cap 45 to be provided with a latching bead 46 and that part of the container body 42 which tapers in the form of a neck to be provided with a latching groove 44. That part of the container body 42 which tapers in the form of a neck and the cap 45, together, form the dispensing head 38. In addition to this two-part configuration of the dispensing head 38, a configuration in which the latter is integrally formed on the container body 42 is also possible.

In order to prevent the toothpaste 26 from running out of the toothpaste container 10 or from drying out therein before being used for the first time, various embodiments of the cap 45 of the dispensing head 38 have a closed outlet opening 34. By virtue of the outlet opening 34 being closed, it is possible for the toothpaste container 10 to be produced and sold/bought separately from the toothbrush body 5. FIG. 4 shows a solution in which a sheet 48 made of plastic or metal is fitted in front of the outlet opening 34. As an alternative, it is possible, as is illustrated in FIG. 5, for the toothpaste container 10 to be closed by a membrane 50 made of the material of the toothpaste container 10 or of the cap 45 or to be closed directly by a thermoplastic elastomer during the production process.

Figure 6:
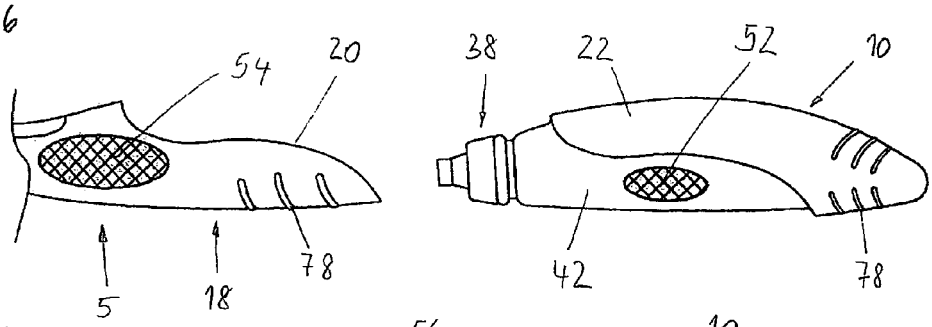
FIG. 6 shows a side view of a handle part of a toothbrush body with a retaining element and of a toothpaste container with a grip hollow, the toothpaste container having been removed.

FIG. 6 shows a toothbrush body 5 with a toothpaste container 10 removed. A recess, designated 52, on the toothpaste container 10 marks a particularly elastic location, for example on account of a lower wall thickness at this location, which is provided in order for the toothpaste 26 to be squeezed out of the toothpaste container 10. The marking of the recess 52 for the user takes place, for example, by a lattice-like surface structure. As an alternative, of course, other surface structures are also possible. The marking may additionally take place by being colored or by flexibly elastic elements being attached by injection molding. The recesses 52 and/or the markings of the recesses 52 may have an additional adhering function. The adhering function for mounting the toothpaste container 10 in the handle part 18 is made possible by the adhering elements interacting with the inner wall of the container holder 20 or adhering elements fitted there.

Stripe-like ribs 78 on the handle part 18 and on the handle shell part 22 serve, on the one hand, for increasing the dimensional stability of the handle part 18 and of the toothpaste container 10 and, on the other hand, for providing a better grip in the user's hand. A better grip is likewise provided by flexibly elastic rest elements 54 fitted on the outer sides of the side walls of the handle part 18.

Figure 7:
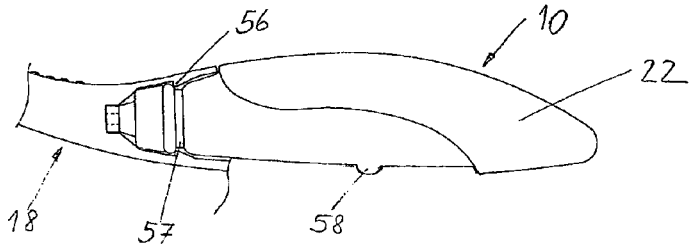
FIG. 7 shows a side view of a further embodiment of a handle part (illustrated in partially transparent form) of a toothbrush body and of a toothpaste container with a latching protuberance, the toothpaste container having been inserted.
Figure 8:
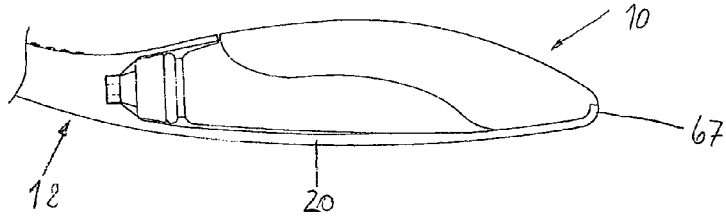
FIG. 8 shows a side view of a further embodiment of a handle part (illustrated in partially transparent form) of a toothbrush with a retaining nose and of an inserted toothpaste container.
Figure 9:
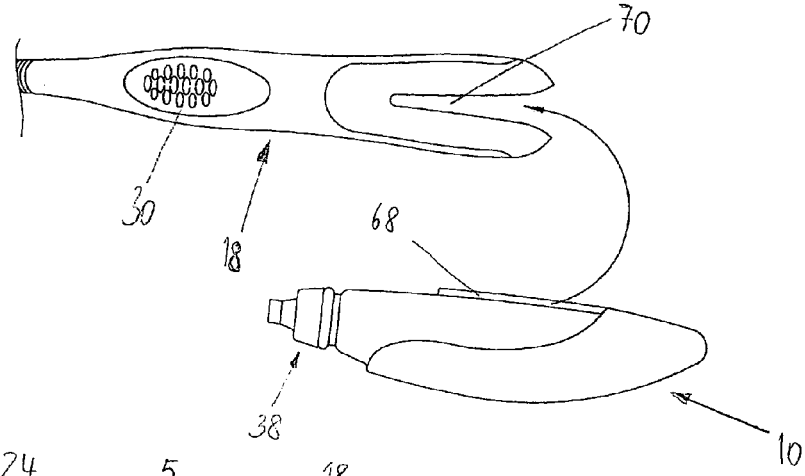
FIG. 9 shows a plan view of a further embodiment of a handle part of a toothbrush with an open incision at the free end of the handle part and of a toothpaste container with a rail-like ridge in side view, the toothpaste container having been removed.

FIGS. 7 to 9 illustrate preferred embodiments for mounting the toothpaste container 10 in the handle part 18 of the toothbrush body 5.

These mounts are preferably prestressed. The prestressing here is less than 50 N, preferably less than 20 N, in order to allow the toothpaste container 10 to be easily removed from the container holder 20.

FIG. 7 shows mounting by virtue of an at least partially encircling latching protrusion 56 of the container holder 20 interacting with a latching groove 57 on the dispensing head 38 of the toothpaste container 10. The latching protrusion 56 preferably has a triangular or semicircular cross section (latching bead). As an alternative, or in addition, the mounting may take place by a latching protuberance 58, which engages in an opening (not shown) or latching step arrangement of the container holder 20. In the case of a latching step arrangement, it is possible for the toothpaste container 10, by virtue of pressure being applied to the handle shell part 22 in the longitudinal direction of the toothbrush body 5, to be pushed from a first latching step into a second latching step, which is located closer to the head 12. As a result, at the same time, the closure pin 36 is introduced into the outlet opening 34 and the toothpaste container 10 is closed. Further forms of a latching or snap-in arrangement which guarantee reliable mounting which can be released a number of times are possible. In particular, interacting ribs 78, protuberances 32, protrusions or indents may be provided, for this purpose, at corresponding positions on the handle part 18 and on the toothpaste container 10.

FIG. 8 shows a further embodiment for mounting the toothpaste container 10 in the handle part 18. In this case, the toothpaste container 10 is prevented from sliding out by virtue of a retaining nose 67 interacting with a correspondingly shaped portion on the toothpaste container 10. The hook-like retaining nose 67 is formed in the free end region of the shovel-like container holder 20 and is prestressed in the direction of the head 12. As an alternative, it is also possible for the retaining nose 67 and the correspondingly shaped portion to be formed at a location of the container holder 20 which is nearer to the head 12.

The container holder 20 may also have centering aids for easier insertion of the toothpaste container 10 into the container holder 20. Such a centering aid is illustrated in FIG. 9. In this case, a longitudinally running, rail-like ridge 68 of the toothpaste container 10 is guided in a displaceable manner into an open incision 70 in the free end region of the shovel-like container holder 20. It is possible for this form of centering to be developed further such that by virtue of self-locking, for example by virtue of wedge-like tapering of the incision 70, the centering serves, at the same time, for arresting the inserted toothpaste container 10 in the container holder 20.

Figure 10:
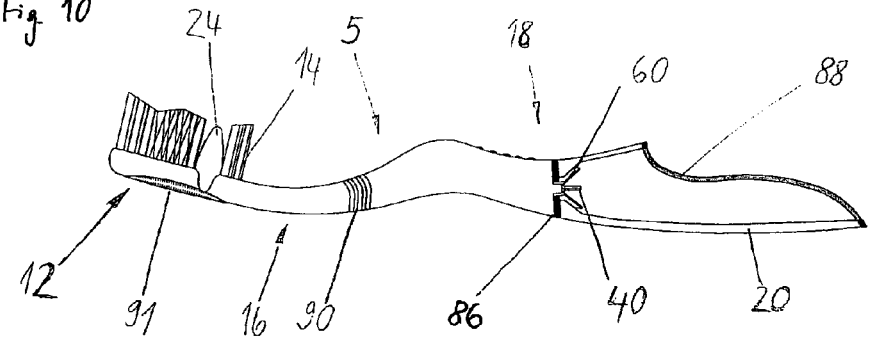
FIG. 10 shows a side view of a toothbrush body (illustrated in partially transparent form) with a centering star and a spike on a container holder.

A further form of centering may take place, as is shown in FIG. 10, by way of a centering star 60 in the container holder 20. This centering star 60 is preferably formed concentrically around the closure pin 36. A closure, for example a sheet material 48 or a membrane 50, as shown in FIGS. 4 and 5 respectively, is opened, when the toothpaste container 10 is used for the first time, by the closure pin 36, as is shown in FIG. 2, or by an additional spike 40 positioned in extension of the closure pin 36.

The embodiment shown in FIG. 10 is additionally provided with a number of flexibly elastic elements. Thus, a dispensing-head seal 86 for closing the outlet opening 34 of the toothpaste container 10 in a sealed manner is located in the container holder 20 of the handle part 18. The dispensing-head seal 86 serves simultaneously as a cushion or damper and makes it easier for the toothpaste container 10 to be inserted and removed. A further flexibly elastic sealing element 88 is fitted along the end surface at the free end of the handle part 18. By virtue of the end surface 43 of the inserted toothpaste container 10 butting against the sealing element 88, liquid or solid substances, in particular, water, are prevented from penetrating.

Further flexibly elastic elements in the form of damping elements 90 are integrated, as has already been described in conjunction with FIGS. 1 and 2, in encircling grooves in the region of the neck 16 of the toothbrush body 5. This creates a flexible zone in the region of the neck 16 with flexibly elastic damping. A flexibly elastic massage element 91, which can be used for massaging the gums, is additionally located on the head 12, on the side located opposite the bristles 14.

All the flexibly elastic elements are preferably shaped and arranged, and connected to one another by channels, such that they can be produced by injection molding in a single step from a single injection point.

Figure 11:
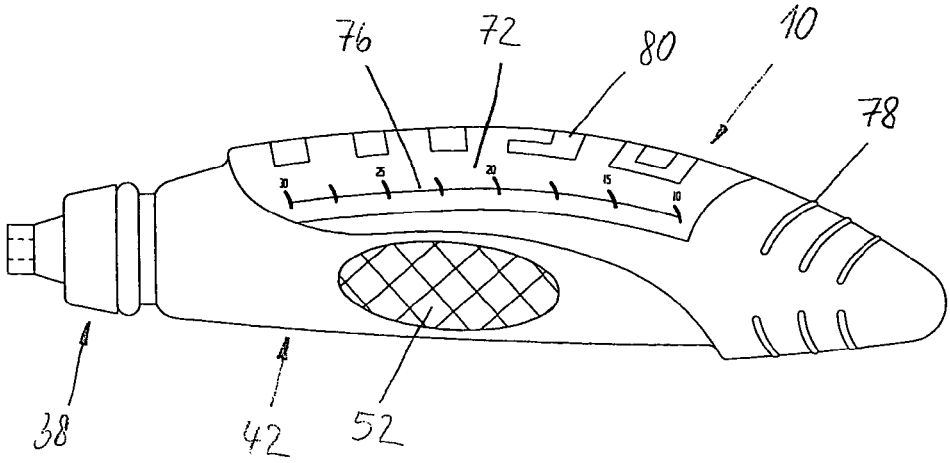
FIG. 11 shows a side view of a toothpaste container with a grip hollow and a filling-level indicator.

It is possible for the toothpaste container 10, corresponding to FIG. 11, to be provided with a filling-level indicator 72. For this purpose, the toothpaste container 10 is produced from transparent or translucent plastic, which allows conclusions to be drawn as to the quantity of toothpaste 26 still located in the toothpaste container 10. By comparing a scale 76, which is preferably provided on the toothpaste container 10, with the quantity of toothpaste 26 which is visible in the toothpaste container 10, it is possible to determine approximately the number of cleaning operations which can still be carried out using the quantity of toothpaste 26 which is located in the toothpaste container 10. As an alternative, it is also possible for the scale 76 to be provided on the handle part 18, preferably on the shovel-like end region of the handle part 18, on the bottom side, which is directed away from the bristles 14. In this case, it is additionally possible for a window (not shown) or a cut-out to be integrated in the bottom side of the handle part 18, with the result that a view is given of the container body 42 and thus of the quantity of toothpaste located therein. This makes it possible to read off the filling level even with the toothpaste container 10 inserted into the handle part 18.

In addition to the filling-level indicator 72, it is also possible for ribs 78, protuberances 32, protrusions or indents, preferably made of the same material of which the toothpaste container 10 itself consists, to be provided on the handle shell part 22. These elements may also be located on other parts of the toothbrush, in particular, on the handle part 18. They provide a better grip for the hand, by preventing the hand from slipping off during cleaning, making it easier for the toothpaste container 10 to be inserted and removed and indicating finger rests and pressure points to the user, for example for the purpose of squeezing out the toothpaste 26. The elements on the toothbrush body 5, in contrast, are preferably fitted by the injection molding of non-slip, flexibly elastic materials. Both the handle shell part 22 and all other parts of the toothbrush which are visible from the outside may be provided with text 80, symbols or any desired monochrome and colored arrangements, for example, for depicting the brand, likewise preferably made of flexibly elastic material.

Figure 12:
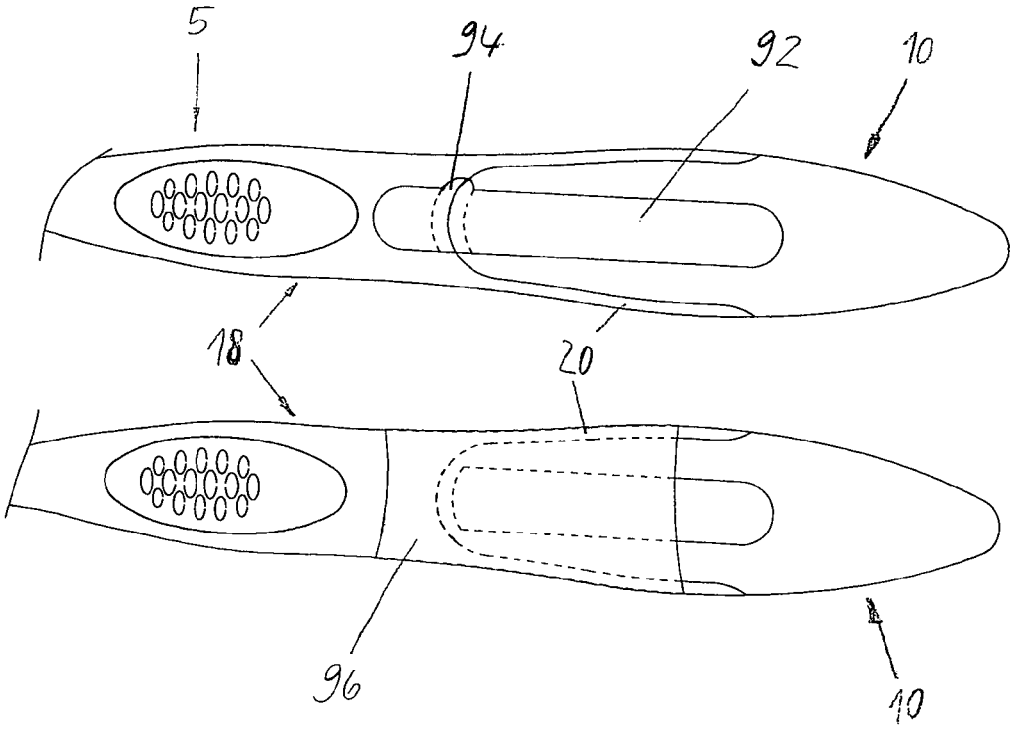
FIG. 12 shows a plan view of a toothbrush with a seal, which extends over part of the handle part and part of the toothpaste container inserted therein, and, there beneath, in a further embodiment, with a skin film.

In order to indicate to the user that the toothpaste container 10 is being used for the first time, it is possible, as is shown in the top part of FIG. 12, to provide a seal 92, which extends over the handle part 18 and the handle shell part 22. It is possible for the seal 92 to be produced, preferably attached by injection molding, for example from a material which is used elsewhere on the handle 19 or, consisting of some other material, to be attached adhesively in the form of a label. The seal 92 preferably has a tab 94 for severing the seal. The tab 94 partially covers the end surface 43 and, on account of perforations running more or less parallel to the end surface 43, is easy to sever. The bottom part of FIG. 12 shows a configuration in the case of which a skin film 96 performs the same function. This extends more or less from the thumb rest 30 to halfway along the length of the handle shell part 22 and encloses the entire circumference of the toothbrush. Before the toothpaste container 10 is first removed from the container holder 20, the seal 92, the label or the skin film 96 has to be severed. The seal 92, the label and the skin film 96 may be provided with text, symbols, brand depictions, etc.

First-time usage may also take place by way of a second latching position, which is covered over by the seal 92, the label or the skin film 96, or is closed in some other way, and has to be reached in order for the toothpaste container 10 to be fully inserted into the handle part 18, being unblocked. Upon transition into the new latching position, the spike 40 opens the sheet material 48 or membrane 50 on the dispensing head 38 of the toothpaste container 10.

For the purpose of applying adhesive labels, certain minimum radii of curvature of the surface of the handle shell part 22 are desirable. For this reason, the radius of curvature in the direction of the longitudinal axis of the toothpaste container 10 is greater than 50 mm and in a direction perpendicular to the longitudinal axis is greater than 10 mm.

The toothpaste 26 located in the toothpaste container 10 is matched to the specific requirements of the toothbrush. The viscosity of the toothpaste 26 and the size of the outlet opening 34 of the toothpaste container 10 are thus set such that, even in the vertical position of the longitudinal axis of the toothpaste container 10 with the outlet opening 34 open and directed downward, very little toothpaste 26, if any at all, runs out.

Since the dimensions of the toothpaste container 10 are smaller than those of known, conventional toothpaste tubes, the concentration of cleaning substances, flavoring agents, etc. in the toothpaste 26, for the toothbrush according to the invention, is selected to be double that of generally known toothpaste. In particular, it is further possible for the toothpaste 26, for cleaning and bleaching purposes, to contain hydrogen peroxide in a concentration of less than 20%, preferably between 3% and 15%, in relation to the volume. Of course, it is also possible for the toothpaste 26 to be used for teeth cleaning using known toothbrushes.

In order to allow the toothpaste 26 to be squeezed out of the toothpaste container 10 as easily as possible, the toothpaste 26 is provided with a dynamic viscosity which is lower than that of conventional toothpaste. With measurements carried out by means of a Couette viscosimeter at a toothpaste temperature of 25° C., the dynamic viscosity should preferably lie in the following ranges:

| Shear rate (1/s) | 10 | 50 | 100 | 200 |
|---|---|---|---|---|
| Dynamic viscosity (Pa s) | 2–15 | 0.7–8 | 0.5–5 | 0.4–5 |

Figure 13:
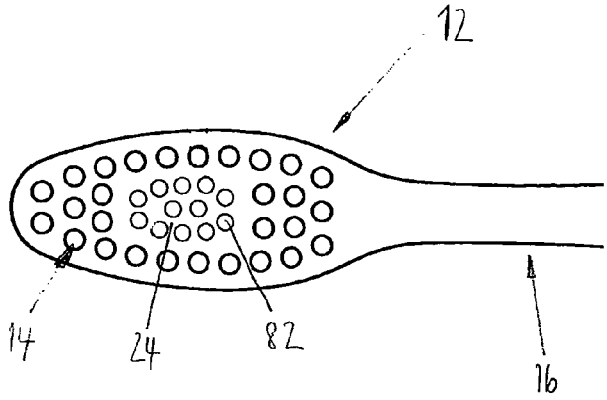
FIG. 13 shows a plan view of an embodiment of a head of a toothbrush with restraining elements made of filaments in an oval arrangement.
Figure 14:
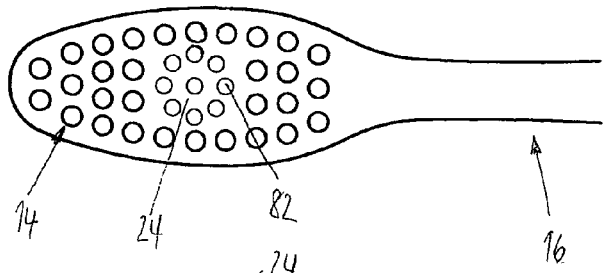
FIG. 14 shows a plan view of a further embodiment of a head of a toothbrush with restraining elements made of filaments in a circular arrangement.
Figure 15:
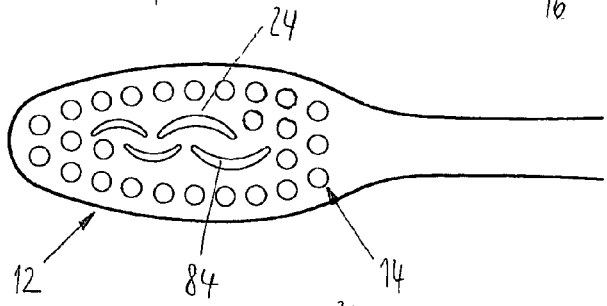
FIG. 15 shows a plan view of a further embodiment of a head of a toothbrush with restraining elements which are offset one behind the other and having a sickle-shaped cross section.
Figure 16:
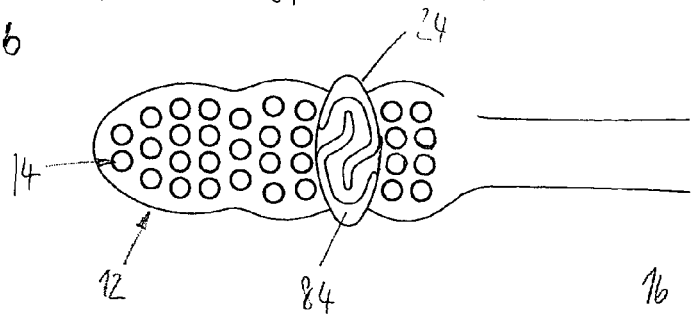
FIG. 16 shows a plan view of a further embodiment of a head of a toothbrush with a restraining element made of walls which interengage in a C-shaped manner.
Figure 17:
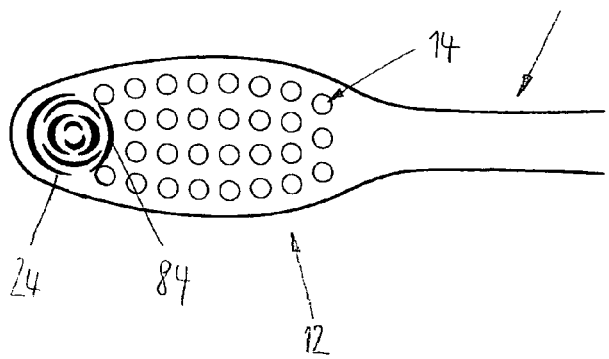
FIG. 17 shows a plan view of a further embodiment of a head of a toothbrush with a rosette-like restraining element.

The toothpaste 26 is prevented from flowing down from the head 12 of the toothbrush in that restraining elements 24, for example in the embodiments shown in FIGS. 13 to 17, are integrated in the head 12. These serve for holding back the toothpaste 26 which has been applied; and at the same time, they allow the toothpaste 26 to be dispensed in metered quantities to the surrounding bristle arrangement. On the one hand, the restraining elements 24 may comprise walls 84, as illustrated in FIGS. 15 to 17. The walls 84 are preferably produced from rubber, thermoplastic elastomers (TPE) or other elastic polymer materials. As with all the flexibly elastic elements of the toothbrush, the Shore A hardness of the walls 84 should be less than 70, preferably less than 50. On the other hand, the restraining elements 24 may also comprise clusters 82 of very thin filaments, as shown in FIGS. 13 and 14, with a diameter of less than 0.175 mm, preferably less than 0.15 mm. The restraining elements 24 are enclosed, at least in part, by bristles 14 or clusters of bristles and are preferably located more or less in the center of the head 12.

Channels which are formed between the walls 84 and the clusters 82 of filaments, and are open upward in the direction of the free bristle ends, accommodate the toothpaste 26. At their openings to the surrounding bristle arrangement, the channels preferably have at least one width of 1.5 mm. The maximum height of the restraining elements 24 is preferably less than 12 mm. As is shown in FIG. 2, they are thus smaller than the longest bristles 14. The restraining elements 24 can be clearly identified, for example by a colored marking, by the consumer. The flexibly elastic walls 84 and/or the clusters 82 may serve, at the same time, for cleaning and massaging the teeth and the gums. Of course, it is also possible for known toothbrushes to be provided with such restraining elements 24.

FIGS. 13 and 14 show an oval arrangement and a circular arrangement of close-together clusters 82 of filaments. In the case of these embodiments, the restraining elements 24 are positioned more or less centrally on the head 12 and are enclosed by conventional bristles 14 and/or clusters of bristles.

FIGS. 15 to 17 show labyrinthine arrangements of restraining elements 24 with flexibly elastic walls 84. In FIG. 15, the walls 84 are of sickle-shaped cross section and are open and offset in relation to one another in their longitudinal directions. In this case, the elongate arrangement is likewise positioned more or less centrally on the elongate head 12 and is enclosed by conventional bristles 14 and/or clusters of bristles.

FIG. 16 illustrates a configuration of a restraining element 24 with two C-shaped walls 84. The openings of the C shapes interengage such that they form an S-shaped channel which is open upward, in the direction of the free bristle ends. The walls 84 and the channel are arranged on a basis oval shape. The longitudinal axis of the basis shape is located more or less at right angles to the longitudinal axis of the head 12. The restraining element 24 here extends over the entire width of the head 12.

FIG. 17 shows a restraining element 24 with a rosette-like arrangement of flexibly elastic walls 84. The walls 84 have a sickle-shaped cross section and are fitted in the free end region of the head 12.

The toothbrush according to the invention is preferably produced in an automated manner in an injection-molding installation which is provided with an oscillating conveyor, in particular for transporting the closed toothpaste containers 10. The toothpaste containers 10 may be produced, filled with toothpaste 26 and closed at a separate location. The operation of inserting the toothpaste containers 10 into the handle part 18 likewise takes place preferably automatically, directly at the injection-molding installation. As an alternative, it is also possible for the toothpaste container 10 to be fitted at an adjoining, automatically fed bristle-tufting apparatus, adjoining to the injection-molding installation. Seals 92, labels or skin films 96 are applied to the toothbrushes directly at the bristle-tufting apparatus.

What is claimed is:

1. A toothbrush with a toothbrush body and a toothpaste container, the toothbrush body having a head which is covered with bristles;

a neck;

a handle part which adjoins the neck and forms a handle together with the toothpaste container, wherein the toothpaste container is removably inserted into the handle part, wherein the toothpaste container has a container body, said container body having a first end equipped with a dispensing head, a second end opposite said dispensing head, a top side and an opposite bottom side;

a handle shell part formed at least partially at said top side of said container body; and a container holder being integrally formed with the handle part, wherein the container holder at least substantially completely encloses said dispensing head and partially encloses said opposite bottom side of the toothpaste container when the toothpaste container is inserted into the handle part, and wherein, the container body is integrally formed with said handle shell part as a single piece which projects beyond the container holder and together with the handle part forms an exterior surface of the handle, the container body together with the handle shell part form a chamber for holding toothpaste, at least part of the container body is thin walled and more flexibly elastic than the rest of the container body, such that, with the toothpaste container removed from the handle part, pressure applied to the toothpaste container will force the toothpaste out of the toothpaste container, and wherein the surface of the handle, essentially maintains its form when subjected to loading which occurs during teeth cleaning, irrespective of the filling level of the toothpaste container.

2. The toothbrush as claimed in claim 1, wherein the handle shell part together with the handle part forms an at least substantially step-free surface of the handle.

3. The toothbrush as claimed in claim 2, wherein the handle part at least substantially completely encloses the dispensing head of the inserted toothpaste container and encloses the container body of the latter asymmetrically such that, on a bottom side of the handle part, which is directed away from the bristles, the container holder engages around the container body, at least as far as a longitudinal center of the container body, and supports the container body laterally, and wherein the handle shell part forms at least part of the surface of the handle on a top side, which is directed toward the bristles.

4. The toothbrush as claimed in claim 1, wherein the toothpaste container removed from the handle part has at least substantially the same form before and after toothpaste has been squeezed out of the toothpaste container.

5. The toothbrush as claimed in claim 1, wherein the thin-walled part is different from the handle shell part and is covered by the container holder.

6. The toothbrush as claimed in claim 1, wherein the handle part and the toothpaste container are provided with retaining elements such that, with the toothpaste container inserted in the handle part, the toothpaste container is retained on the handle part by interaction of the retaining elements, which are designed as adhering elements, between which there is sufficient static friction, or as a latching protrusion and latching groove for latching-in purposes, or as a latching protuberance and a corresponding latching step arrangement, or as a hook-like retaining nose and a correspondingly shaped portion.

7. The toothbrush as claimed in claim 1, wherein, with the toothpaste container inserted in the handle part, a closure pin of the handle part closes an outlet opening on a dispensing head of the toothpaste container in a sealed manner.

8. The toothbrush as claimed in claim 1, wherein, on an encircling free end surface, the handle part has a sealing element which, with the toothpaste container inserted in the handle part, interacts with a peripheral end surface of the toothpaste container in order to prevent water from penetrating to a dispensing head, and wherein the container holder has a flexibly elastic dispensing-head seal on a closure pin in order to prevent toothpaste from running out of the toothpaste container.

9. The toothbrush as claimed in claim 1, wherein a ridge of the toothpaste container engages in an incision of the container holder which runs at least substantially in a longitudinal direction of the handle part, and wherein the toothpaste container is introduced into a centering star of the handle part.

10. The toothbrush as claimed in claim 1, wherein the handle part is provided with a spike which, when the toothpaste container is inserted into the container holder for the first time, the spike is intended to open a closure on the dispensing head of the toothpaste container.

11. The toothbrush as claimed in claim 1, wherein at least part of the toothpaste container is transparent or translucent such that a quantity of toothpaste located therein is visible, and a scale is provided on the toothpaste container or on an end region of the handle part, in order to form a filling level indicator.

12. The toothbrush as claimed in claim 11, wherein the handle part includes:

a window or a cut-out providing a view of the toothpaste container.

13. The toothbrush as claimed in claim 1, wherein the handle part or a handle shell part includes ribs, protuberances, protrusions or indents which are produced on the handle part.

14. The toothbrush as claimed in claim 13, wherein the protuberances, protrusions or indents are produced on the handle part from a non-slip, flexibly elastic material.

15. The toothbrush as claimed in claim 1, wherein a viscosity of toothpaste located in the toothpaste container and a size of an outlet opening of the toothpaste container are set such that, in a vertical position of a longitudinal axis of the toothpaste container with the outlet opening open and directed downward, little to none of the toothpaste passes out of the opening.

16. The toothbrush as claimed in claim 1, wherein the head is provided with a restraining element for partially holding back toothpaste applied to the head.

17. The toothbrush as claimed in claim 1, wherein the dispensing head is closed in a sealed manner to prevent the toothpaste from running out of the toothpaste container when the toothpaste container is inserted in the handle.

18. The toothbrush as claimed in claim 1, wherein, on an encircling free end surface, the handle part has a sealing element which, with the toothpaste container inserted in the handle part, interacts with a peripheral end surface of the toothpaste container in order to prevent water from penetrating to a dispensing head, or wherein the container holder has a flexibly elastic dispensing-head seal on a closure pin in order to prevent toothpaste from running out of the toothpaste container.

19. The toothbrush as claimed in claim 1, wherein a ridge of the toothpaste container engages in an incision of the container holder which runs at least substantially in a longitudinal direction of the handle part, or wherein the toothpaste container is introduced into a centering star of the handle part.

20. A toothbrush body for a toothbrush, the toothbrush body having a head, which is covered with bristles, a neck, and a handle part, which adjoins the neck and on which is integrally formed a container holder which is intended for accommodating a toothpaste container inserted into the handle part and for partially enclosing the toothpaste container when inserted therein, wherein the toothpaste container has a dispensing head, which is closed in a sealed manner to prevent toothpaste from running out of the toothpaste container when the toothpaste container is inserted in the handle part, and a container body, said container body having a first end equipped with the dispensing head, the toothpaste container further having a second end opposite said dispensing head, a top side and an opposite bottom side, wherein the container body is integrally formed with a handle shell part as a single piece which projects beyond the container holder and together with the handle part forms an exterior surface of the handle, the container body together with the handle shell part form a chamber for holding toothpaste, at least part of the container body being thin walled and more flexibly elastic than the rest of the container body, such that, only with the toothpaste container removed from the handle part, pressure applied to the toothpaste container will force the toothpaste out of the toothpaste container, wherein the container holder at least substantially completely encloses said dispensing head and partially encloses said opposite bottom side of the toothpaste container;

wherein the handle shell part formed at least partially at said top side of said container body, and wherein the handle part forms a handle together with the inserted toothpaste container, and wherein a surface of the handle, including the handle part and the toothpaste container, essentially maintains its form when subjected to loading which occurs during teeth cleaning, irrespective of the filling level of the toothpaste container.

21. A toothbrush with a toothbrush body and a toothpaste container, the toothbrush body having a head which is covered with bristles;

a neck;

a handle part which adjoins the neck and forms a handle together with the toothpaste container, a container holder being integrally formed with the handle part; the toothpaste container having a dispensing head;

a container body having a first end equipped with the dispensing head;

a second end opposite said dispensing head;

a top side;

an opposite bottom side; and a handle shell part formed at least partially at said top side of said container body, the container body being integrally formed as a single piece which projects beyond the container holder and together with the handle part forms an exterior surface of the handle, the container body together with said handle shell part to form a chamber for holding toothpaste that is releasably inserted into said container holder of said handle part of the toothbrush, wherein the container holder at least substantially completely encloses said dispensing head and partially encloses said opposite bottom side of the toothpaste container, the dispensing head being closed in a sealed manner to prevent the toothpaste from running out of the toothpaste container when the toothpaste container is inserted in the handle part; and at least part of the container body being thin walled and more flexibly elastic than the rest of the container body, such that, only with the toothpaste container removed from the handle part, pressure applied to the toothpaste container will force the toothpaste out of the toothpaste container, wherein the handle shell part essentially maintains its form when subjected to loading which occurs during teeth cleaning, irrespective of the filling level of the toothpaste container, and forms the surface of a handle together with the handle part.

* * * * *